US009707597B2

(12) United States Patent
Zwerner et al.

(10) Patent No.: US 9,707,597 B2
(45) Date of Patent: Jul. 18, 2017

(54) RECONFORMABLE MATERIAL REMOVAL SYSTEM

(71) Applicants: John Stephen Zwerner, Scottsdale, AZ (US); David James Roy Robinson, Friday Harbor, WA (US)

(72) Inventors: John Stephen Zwerner, Scottsdale, AZ (US); David James Roy Robinson, Friday Harbor, WA (US)

(73) Assignees: John Stephen Zwerner, Scottsdale, AZ (US); David James Roy Robinson, Friday Harbor, WA (US)

( * ) Notice: Subject to any disclaimer, the term of this patent is extended or adjusted under 35 U.S.C. 154(b) by 190 days.

(21) Appl. No.: 14/730,783

(22) Filed: Jun. 4, 2015

(65) Prior Publication Data

US 2016/0354810 A1 Dec. 8, 2016

(51) Int. Cl.
*B08B 1/00* (2006.01)
*E01H 1/02* (2006.01)
(Continued)

(52) U.S. Cl.
CPC ..... *B08B 1/005* (2013.01); *E01H 1/00* (2013.01); *E01H 1/02* (2013.01); *E01H 5/06* (2013.01); *E01H 5/062* (2013.01); *E01H 5/065* (2013.01)

(58) Field of Classification Search
CPC E01H 1/00; E01H 1/02; E01H 1/0872; E01H 1/105; E01H 5/06; E01H 5/061;
(Continued)

(56) References Cited

U.S. PATENT DOCUMENTS 176,476 A * 4/1876 Neff ..... A47L 13/08 15/236.06
2,655,721 A 10/1953 Einhorn
(Continued)

FOREIGN PATENT DOCUMENTS

DE 388203 * 1/1924
DE 881200 * 6/1953
(Continued)

OTHER PUBLICATIONS

International Search Report Dated Sep. 12, 2016 International Application No. PCT/US2016/034049.
(Continued)

*Primary Examiner* — Mark Spisich
(74) *Attorney, Agent, or Firm* — Cantor Colburn LLP

(57) ABSTRACT

A re-conformable material removal system comprises a head or receiver portion having an inner chamber with a plurality of material removal members arranged in side-by-side relationship to one another. First, actuator ends are disposed in the inner chamber of the head or receiver portion and second, surface contact ends project outwardly to define a contact edge. A biasing member is disposed within the inner chamber of the head or receiver portion, between the material removal members and the top, to yieldably bias the material removal members in an extended position wherein placement of the re-conformable material removal system against a surface results in yielding of the biasing member and movement of the material removal members into the inner chamber when the surface is uneven thereby resulting a conformed contact edge that is continuously adjustable and conformable to the contour of the surface.

20 Claims, 2 Drawing Sheets

(51) Int. Cl.
*E01H 5/06* (2006.01)
*E01H 1/00* (2006.01)

(58) Field of Classification Search
CPC ..... E01H 5/062; E01H 5/063; E01H 5/065; B44D 3/162; B44D 3/164; B60S 3/045; B08B 1/005; A47L 13/02; A47L 13/022; A47L 13/08; A47L 13/11; A47L 1/06
USPC ... 15/3, 78, 236.01, 236.02, 236.05, 236.06, 15/236.08, 236.09, 245, 245.1; 30/169, 30/172; 37/232, 233
See application file for complete search history.

(56) References Cited

U.S. PATENT DOCUMENTS

| | | | | | |
|---|---|---|---|---|---|
| 3,110,919 | A | * | 11/1963 | Barnby | G03F 7/12 101/120 |
| 3,125,142 | A | * | 3/1964 | Andersson | B27L 1/08 144/208.4 |
| 3,165,832 | A | | 1/1965 | Stipcevich | |
| 3,530,578 | A | | 9/1970 | Katz | |
| 3,800,354 | A | | 4/1974 | Stephens | |
| 4,112,537 | A | | 9/1978 | Heuck | |
| 4,601,776 | A | * | 7/1986 | Kral | B25B 27/00 156/717 |
| 4,958,403 | A | | 9/1990 | Martin | |
| 5,140,763 | A | * | 8/1992 | Nichols, IV | E01H 5/062 37/233 |
| 5,181,292 | A | | 1/1993 | Aghachi | |
| 5,255,406 | A | | 10/1993 | Rood | |
| 5,720,071 | A | | 2/1998 | Hall | |
| 5,819,443 | A | * | 10/1998 | Winter | E01H 1/105 172/766 |
| 6,095,318 | A | | 8/2000 | Brink | |
| 6,311,399 | B1 | * | 11/2001 | Steelman | B29C 63/0078 30/365 |
| 6,643,888 | B2 | | 11/2003 | Griffith | |
| 7,469,444 | B1 | | 12/2008 | Thomas | |
| 2008/0313934 | A1 | | 12/2008 | Smoljo | |
| 2011/0138566 | A1 | | 6/2011 | Wang | |

FOREIGN PATENT DOCUMENTS

| | | | |
|---|---|---|---|
| EP | 352570 | * | 1/1990 |
| FR | 2789289 | * | 8/2000 |
| GB | 22079 | * | 0/1911 |
| GB | 667749 | * | 3/1952 |

OTHER PUBLICATIONS

Written Opinion of International Searching Authority Dated Sep. 12, 2016 International Application No. PCT/US2016/034049.

* cited by examiner

RECONFORMABLE MATERIAL REMOVAL SYSTEM

FIELD OF THE INVENTION

The subject of the invention is related to material removal systems for use on flat to uneven surfaces and, more particularly, to a material removal system with continuously adjustable surface contour compensation.

BACKGROUND

The removal of material from surfaces is a common activity in virtually every industry. Whether it be removal of paint, corrosion or dirt from metal or wood surfaces, cooking residue from barbeque grills or snow and water from road surfaces (to name just a few examples) material removers typically suffer from a common shortcoming; the inability to continuously and dynamically adjust to changes in the surface contour from which the material is being removed.

SUMMARY OF THE INVENTION

In an exemplary embodiment a re-conformable material removal system comprises a head or receiver. A plurality of material removal members are arranged in side-by-side relationship to one another having first, actuator ends disposed in the inner chamber of the head or receiver portion and second, surface contact ends projecting outwardly from the head or receiver portion to define a straight front edge. A biasing member is disposed within the inner chamber of the head or receiver portion, between each material removal member and a top, to yieldably bias the material removal members in an extended position wherein placement of the re-conformable material removal system against a surface results in yielding of the biasing member and movement of the material removal members into the inner chamber when the surface is uneven thereby resulting a conformed front edge that is continuously adjustable and conformable to the contour of the surface.

In another exemplary embodiment, a vehicle mounted re-conformable material removal system comprises a head or receiver portion attachable to the vehicle via an adjustable mount extending therebetween. The head or receiver portion has an inner chamber. A plurality of material removal members, arranged in side-by-side relationship to one another, have first, actuator ends disposed in the inner chamber of the head or receiver portion and second, surface contact ends projecting outwardly from the head or receiver portion to define a contact edge. A biasing member is disposed within the inner chamber of the head or receiver portion between each of the plurality of material removal members and a top, to yieldably bias the material removal members into an extended position, wherein placement of the re-conformable material removal system against a surface results in yielding of the biasing member and movement of the material removal members into the inner chamber when the surface is uneven, resulting a conforming contact edge that is continuously adjustable and conformable to the contour of the surface.

The above features and advantages, and other features and advantages of the invention, are readily apparent from the following detailed description of the invention when taken in connection with the accompanying drawings.

BRIEF DESCRIPTION OF THE DRAWINGS

Other features, advantages and details appear, by way of example only, in the following detailed description of the embodiments, the detailed description referring to the drawings in which.

DESCRIPTION OF THE EMBODIMENTS

Figure 1:
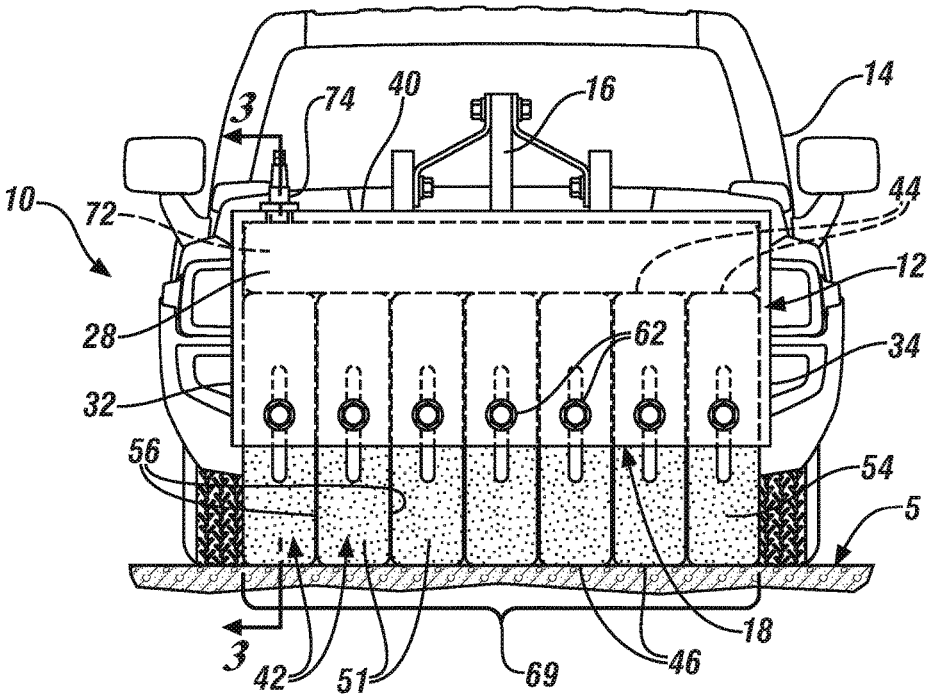
FIG. 1 is a front view of a vehicle mounted re-conformable material removal system embodying features of the invention.

The following description is merely exemplary in nature and is not intended to limit the present disclosure, its application or uses. It should be understood that throughout the drawings, corresponding reference numerals indicate like or corresponding parts and features. As used herein, the term vehicle is not limited to just an automobile, truck, van or sport utility vehicle, but includes any self-propelled or towed conveyance suitable for transporting a burden.

Figure 2:
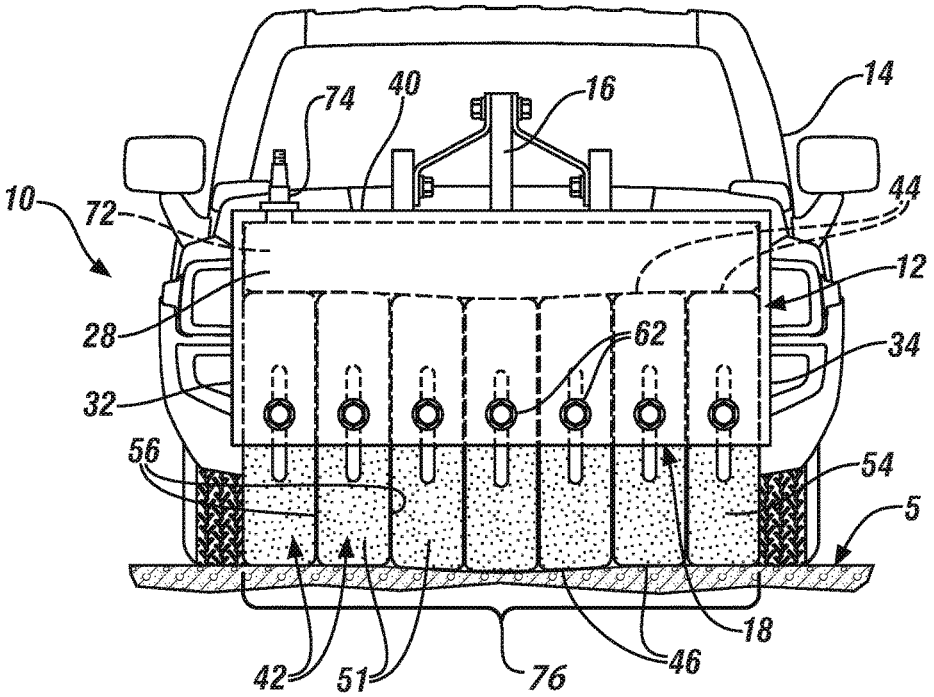
FIG. 2 is another front view of the re-conformable material removal system of FIG. 1.

Referring now to FIGS. 1 and 2, in an exemplary embodiment, a re-conformable material removal system 10 is shown. The system 10 may include a head or receiver portion 12 that is attachable to a vehicle 14 via an adjustable mount 16 extending therebetween. The adjustable mount 16 may include controls that are operable by a vehicle operator to adjust the height, angle, downward pressure and other aspects of the material removal system 10 while the vehicle 14 is in operation or, may be robotically through an intelligent vision system, or otherwise automatically operated to provide control of the material removal system.

Figure 3:
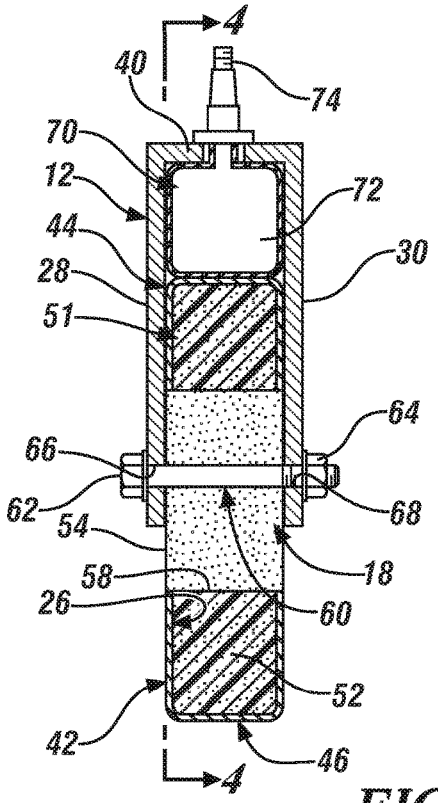
FIG. 3 is a schematic, sectional side view of the re-conformable material removal system of FIG. 1, taken along section line 3-3.
Figure 4:
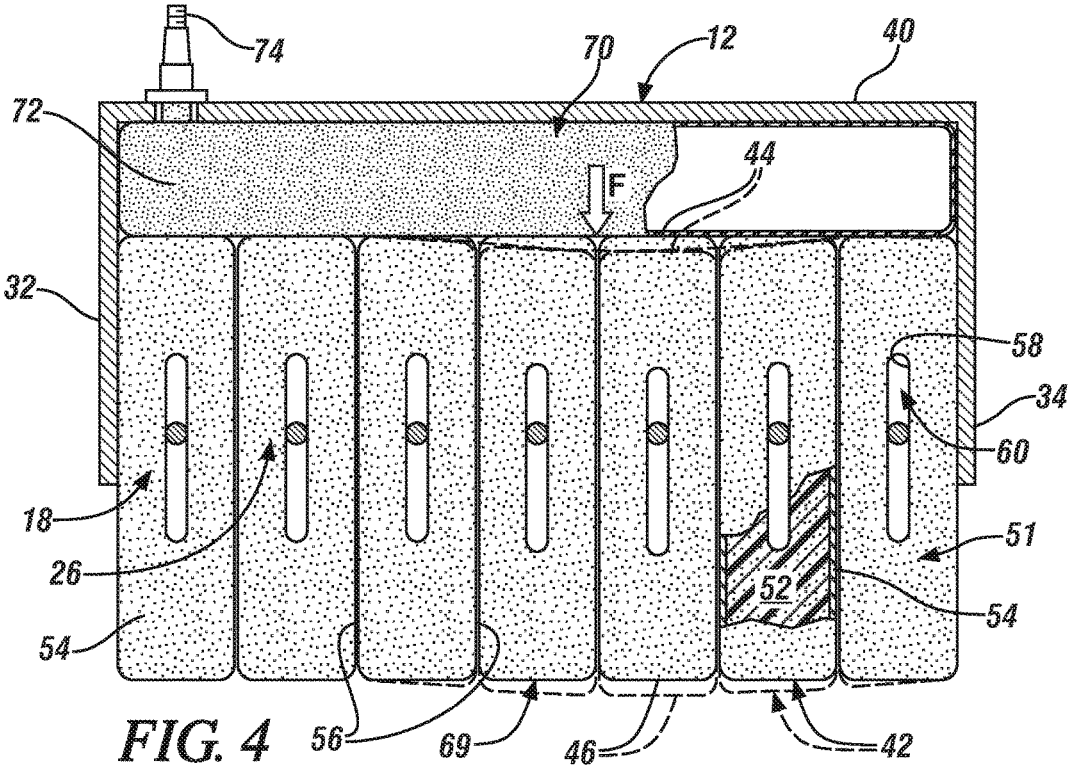
FIG. 4 is a schematic, sectional front view of the re-conformable material removal system taken along line 4-4 of FIG. 3.

Referring to FIGS. 3 and 4, with continuing reference to FIGS. 1 and 2, in an embodiment, the head or receiver portion 12 is constructed of a rigid material that includes an opening 18 leading to an inner chamber 26 that is bounded by front and back walls 28, 30 and side walls 32, 34, respectively. In an embodiment, the head or receiver portion 12 includes a top or upper wall 40.

In an embodiment, a material removal member 42 may comprise a first, actuator end 44 and a second, surface contact end 46. While configuration of the material removal member 42 will vary for differing applications of the re-conformable material removal system 10, in an exemplary embodiment the material removal member 42 is an axially extending pillow 51 that extends from the first, actuator end 44 to the second, surface contact end 46. The material removal member 42 includes a core 52 that, in a preferred embodiment may comprise new or recycled rubber material or other suitable material that may be sacrificed to achieve the desired result of clearing the surface 5 without negatively affecting the surface, and an outer material or shell 54 which may be constructed of injection molded composite material or composite or plastic, for example. It is contemplated that the core 52 and encapsulation material or shell 54 may be fabricated from any suitable material that enables system 10 to function as described herein. The encapsulation material or shell 54 facilitates the relative movement of the material removal members 42 against one another, having a relatively low coefficient of friction. During operation, the outer material that is in contact with the surface 5 that is being cleared will be sacrificed as the material removal member 42 is worn down (i.e. sacrificed) over time thereby exposing the material of the core 52 to the surface 5.

As suggested above, flat, contact or sliding surfaces 56 comprising outer material or shell 54 may extend axially along either side of the material removal members 42 to facilitate relative, up-and-down motion therebetween. Such relative motion is enabled via axially extending through-slots 58 that, in the embodiment illustrated, extend through each material removal member 42 from front to rear. A plurality of pairs of longitudinally aligned openings 66 and 68 extend through the front wall 28 and back wall 30 of the head or receiver portion 12. The pairs of openings 66, 68 are positioned horizontally across the head or receiver portion in alignment with the through slots 58 in the material removal members 42. A guide shaft 60, which may, in an embodiment, comprise a bolt 62 and nut 64 combination, extends through each pair of openings 66, 68 and a corresponding through slot 58 of a material removal member 42, FIGS. 3 and 4, and function to retain the material removal member in position within the head or receiver portion 12 while also facilitating relative, up-and-down motion therebetween.

In an exemplary embodiment, a plurality of material removal members 42 are inserted into the head or receiver portion 12 such that the surface contact ends 46 project outwardly from the opening 18. The plurality of material removal members 42 are arranged in side-by-side relationship to one another such that the flat, contact or sliding surfaces 56 are in sliding contact with one another. As indicated, the guide shafts 60 function to retain the material removal members in position within the head or receiver portion 12 and, because each material removal member 42 may have the same axial length, a contact edge 69, FIG. 1, is defined by the surface contact ends 46 of the plurality of material removal members 42.

In one embodiment, placement of the through slots 58 intermediate of the length of the material removal members 42 allows for the members to be removed from the head or receiver portion 12 and reversed. More specifically, by reversing the position of the material removal members 42, the first, actuator end 44 may be utilized as the surface contact end 46 thereby extending the useful life of each material removal member 42. In another embodiment, the shell material 54 and the core 52 may vary on the first or actuator end 44 and the second, surface or contact end 46 to account for various applications of the system 10. For instance, the material removal members may be reversed in cases of varying surface 5 conditions necessitating differing materials 52, 54 for improved performance.

A biasing member 70 is disposed within the head or receiver portion 12 between the actuator end 44 of the material removal member 42 and the upper wall 40. The biasing member 70 acts with a force "F" on each material removal member to yieldably maintain it in an extended position. In an embodiment, the biasing member 70 may comprise a hydraulic or pneumatic cell 72 having a valve 74, or other pressure input system, that may be utilized to vary the pressure within the cell 72 to thereby vary the force "F" that acts on the first, actuator ends 44 of the material removal members 42. The hydraulic or pneumatic cell 72 may be constructed as a flexible bladder that may be fabricated from an elastically deformable material or any suitable material that enables system 10 to function as described herein. The embodiment illustrated in the Figures shows one biasing member 70 comprising a hydraulic or pneumatic cell 72 disposed within the head or receiver portion 12 and configured to act against all of the material removal members 42. It is contemplated that individual biasing members 70 may also be disposed within the head or receiver portion 12 and configured to act against each of the material removal members 42 individually.

Placement of the re-conformable material removal system 10 against a surface such as a roadway or track pavement 5 may result in yielding of the biasing member 70 if the surface is uneven; resulting in greater upward pressure being exerted by the surface 5 on the contact edge 69 defined by the plurality of material removal members 42. The result is a "conformable" contact edge 76, FIG. 2 that is continuously adjustable and conformable to the contour of the pavement 5 as the material removal system 10 and the vehicle 14 are moved. When upward force is removed from the system 10 (i.e. when the pavement 5 is level) the biasing member 70 acts on the first, actuator ends 44 of the plurality of material removal member 42 to return them to an extended position, FIG. 1.

The invention disclosed herein is directed to a re-conformable material removal system 10 that includes a plurality of moveable, side-by-side material removal members 42 that cooperate to define a contact edge 69 or a conformable contact edge 72 when applied to an uneven surface such as pavement 5. It is contemplated that the re-conformable material removal system 10 may be scaled for applications of any size. While the invention has been described with reference to exemplary embodiments, it will be understood by those skilled in the art that various changes may be made and equivalents may be substituted for elements thereof without departing from the scope of the invention. In addition, many modifications may be made to adapt a particular situation of material to the teachings of the invention without departing from the essential scope thereof. Therefore, it is intended that the invention not be limited to the particular embodiments disclosed, but that the invention will include all embodiments falling within the scope of the application.

What is claimed is:

1. A re-conformable material removal system comprising:

a head or receiver portion having an inner chamber;

a plurality of material removal members, arranged in side-by-side relationship to one another, having first, actuator ends disposed in the inner chamber of the head or receiver portion and second, surface contact ends projecting outwardly through an opening in the head or receiver portion to define a contact edge, one or more of the material removal members including a core surrounded by an outer shell; and a biasing member disposed within the inner chamber of the head or receiver portion between each of the plurality of material removal members and a top of the head or receiver portion, to yieldably bias the material removal members into an extended position, wherein placement of the re-conformable material removal system against a surface results in yielding of the biasing member and movement of the material removal members into the inner chamber when the surface is uneven, resulting in a conforming contact edge that is continuously adjustable and conformable to the contour of the surface.

2. The re-conformable material removal system of claim 1, wherein each of the material removal members comprises an axially extending pillow that extends from the first, actuator ends to the second, surface contact ends, each axially extending pillow including a deformable core and a semi-rigid outer shell.

3. The re-conformable material removal system of claim 1, further comprising:

axially extending through-slots extending through the material removal members from front to rear;

a plurality of pairs of longitudinally aligned openings extending through a front wall and a back wall of the head or receiver portion, the pairs of openings positioned horizontally across the head or receiver portion, in alignment with the axially extending through-slots of the material removal members; and a guide shaft extending through each pair of longitudinally aligned openings and corresponding through-slots to retain the material removal members in position within the head or receiver portion to facilitate relative up-and-down motion therebetween.

4. The re-conformable material removal system of claim 3, wherein the axially extending through-slots are disposed intermediate of the length of the material removal members facilitating removal from the head or receiver portion, reversal and re-installation therein.

5. The re-conformable material removal system of claim 4, wherein a material forming the core and a material forming one or more of the shells varies at the first or actuator end and the second, surface or contact end.

6. The re-conformable material removal system of claim 1, further comprising:

the biasing member configured to act with a force "F" on the material removal members to yieldably maintain the members in the extended position.

7. The re-conformable material removal system of claim 6, the biasing member further comprising:

one of a hydraulic or pneumatic cell constructed as a flexible bladder.

8. The re-conformable material removal system of claim 7, the biasing member further comprising:

a pressure input system configured to vary the pressure within the hydraulic or pneumatic cell to thereby vary a force "F" that acts on the first, actuator ends of the material removal members.

9. The re-conformable material removal system of claim 1, wherein the outer shell comprises a sacrificial material configured to be deposited onto the surface.

10. A vehicle mounted re-conformable material removal system comprising:

a head or receiver portion having an inner chamber attachable to the vehicle via an adjustable mount extending therebetween;

a plurality of material removal members, arranged in side-by-side relationship to one another, having first, actuator ends disposed in the inner chamber of the head or receiver portion and second, surface contact ends projecting outwardly from an opening in the head or receiver portion to define a contact edge, one or more of the material removal members including a core surrounded by an outer shell; and a biasing member disposed within the inner chamber of the head or receiver portion between each of the plurality of material removal members and a top of the head or receiver portion, to yieldably bias the material removal members into an extended position, wherein placement of the re-conformable material removal system against a surface results in yielding of the biasing member and movement of the material removal members into the inner chamber when the surface is uneven, resulting in a conforming contact edge that is continuously adjustable and conformable to the contour of the surface.

11. The vehicle mounted re-conformable material removal system of claim 10, wherein each of the material removal members comprises an axially extending pillow that extends from the first, actuator ends to the second, surface contact ends, each axially extending pillow including a deformable core and a semi-rigid outer shell.

12. The vehicle mounted re-conformable material removal system of claim 10, further comprising:

axially extending through-slots extending through the material removal members from front to rear;

a plurality of pairs of longitudinally aligned openings extending through a front wall and a back wall of the head or receiver portion, the pairs of openings positioned horizontally across the head or receiver portion, in alignment with the axially extending through-slots of the material removal members; and a guide shaft extending through each pair of openings and corresponding through-slots to retain the material removal members in position within the head or receiver portion to facilitate relative up-and-down motion therebetween.

13. The vehicle mounted re-conformable material removal system of claim 12, wherein the axially extending through-slots are disposed intermediate of the length of the material removal members facilitating removal from the head or receiver portion, reversal and re-installation therein.

14. The vehicle mounted re-conformable material removal system of claim 13, wherein a material forming the core and a material forming the shell varies at the first or actuator end and the second, surface or contact end.

15. The vehicle mounted re-conformable material removal system of claim 10, further comprising:

the biasing member configured to act with a force "F" on the material removal members to yieldably maintain the members in the extended position.

16. The vehicle mounted re-conformable material removal system of claim 15, the biasing member further comprising:

one of a hydraulic or pneumatic cell constructed as a flexible bladder.

17. The vehicle mounted re-conformable material removal system of claim 16, the biasing member further comprising:

a pressure input system configured to vary the pressure within the hydraulic or pneumatic cell to thereby vary a force "F" that acts on the first, actuator ends of the material removal members.

18. The vehicle mounted re-conformable material removal system of claim 10, wherein the surface comprises pavement.

19. The vehicle mounted re-conformable material removal system of claim 10, the adjustable mount including controls that are operable by a vehicle operator to provide control of the material removal system.

20. The vehicle mounted re-conformable material removal system of claim 10, the adjustable mount including controls that are operable robotically through an intelligent vision system, or otherwise automatically operated to provide control of the material removal system.

* * * * *